356-153 SR
PR012 XR 4,139,769

United States Patent [19]

McCrum et al.

[11] 4,139,769

[45] Feb. 13, 1979

[54] BORESIGHT METHOD AND APPARATUS

[75] Inventors: Eugene F. McCrum, Garden Grove; William K. Tomita, Huntington Beach; James G. Myers, Corona del Mar; John T. Rehak, Santa Ana, all of Calif.

[73] Assignee: Ford Aerospace & Communications Corporation, Dearborn, Mich.

[21] Appl. No.: 835,557

[22] Filed: Sep. 22, 1977

[51] Int. Cl.[2] ..... G01J 1/00

[52] U.S. Cl. ..... 250/341; 250/339

[58] Field of Search ..... 250/330, 339, 341, 342

[56] References Cited

U.S. PATENT DOCUMENTS

| | | | |
|---|---|---|---|
| 3,500,048 | 3/1970 | Menke | 250/342 |
| 3,752,587 | 8/1973 | Myers et al. | 356/153 |
| 4,087,689 | 5/1978 | Asawa | 250/342 |

*Primary Examiner*—Alfred E. Smith
*Assistant Examiner*—Janice A. Howell
*Attorney, Agent, or Firm*—Paul K. Godwin, Jr.; Keith L. Zerschling

[57] ABSTRACT

In a system employing a collimated beam projector radiating energy of a single wavelength and an image detector sensitive to a band of wavelengths, a boresight technique includes the steps of extracting a portion of the projected beam, focusing the extracted portion onto a predetermined point of a boresight target material until said material responsively emits radiation in said band of wavelengths, and collimating the emitted radiation into said image detector at a field of view location corresponding to the projected beam location.

24 Claims, 3 Drawing Figures

BORESIGHT METHOD AND APPARATUS

BACKGROUND OF THE INVENTION

1. Field of the Invention

The present invention relates to the art of boresighting parallel line of sight detectors in the ultraviolet, infrared and/or visible wavelength bands with laser generated beams of radiation outside the detected bands.

2. Description of the Prior Art

Visible wavelength band TV detector systems are commonly employed aboard aircraft to sense images of the terrain or other targets within the field of view and to present those images to the pilot and/or others via a CRT display. In some instances, such as that discussed in commonly assigned U.S. Pat. No. 3,752,587, and incorporated herein by reference, a laser is also employed to direct an invisible beam of radiation onto a distant target that is in the line of sight of the visible band detector. It is, of course, most desirable to have the central line of sight of the visible band detector at the approximate center of the display screen reticle and to likewise have the line of sight aligned with the projection path of the invisible laser beam radiation.

In the case of the above referenced U.S. Pat. No. 3,752,587, a laser beam is projected and visible band images are received for detection via a common optical system along a common optical path. When it is desirable to boresight the reticle center on the display screen, a reflector element is rotated into the common path and diverts a portion of the projected laser beam to a lens. That lens focuses the beam onto an opaque surface, which is capable of being perforated by the invisible focused laser beam. The opaque surface is backlit with a source of visible band radiation and the perforation is imaged as a bright spot by a vidicon detector via the focusing lens and the reflector element. Boresight alignment can then be achieved by adjusting the reticle on the TV display so that its center coincides with the bright spot visible on the display, since the bright spot corresponds to the location of the laser beam projection path with respect to the displayed image.

The prior art method illustrates the use of an auxiliary light source and an advancing mechanism to supply an opaque surface for perforation by the focused laser. Each of these active elements increases the chance of failure, and requires an electrical supply.

SUMMARY OF THE INVENTION

The present invention accomplishes the checking of boresight alignment of a visible band TV type detector with an invisible beam of laser radiation, as well as the checking of boresight alignment of an infrared detector with the same beam of laser radiation. In addition, the boresighting is achieved by utilizing a compact optical system that employs passive/reactive elements.

In the present invention, a visible wavelength band detector is mounted to receive visible images in a field of view about a first axis and a laser is mounted to project a monochromatic collimated beam of infrared radiation along the first axis. The visible detector is not responsive to infrared radiation and, therefore, cannot detect the field of view location of the projected laser beam. Accordingly, it is an object of the present invention, for boresight purposes, to convert a portion of the infrared radiation of the projected laser beam to the visible wavelength band and redirect that converted radiation into the visible band detector at the corresponding position of the projected laser beam in the field of view. The detected converted radiation appears as a bright spot on the display and serves as a reference point for centering the display reticle.

It is a further object of the present invention to achieve boresight alignment of an infrared band detector with both the visible band detector and the infrared laser, which radiates outside the detected band, so that the infrared detector detects images within its field of view about a second axis substantially parallel to the first axis. In order to achieve this objective, it is necessary to produce a reference point that is detectable by both the visible band detector and the infrared band detector. The present invention employs a boresight target material having thermal gray body emission characteristics to receive the laser radiation. The target material also has thermal insulating properties so that the size of the spot receiving a concentrated amount of laser radiation will be resisted from growing. Therefore, the beam of laser radiation is sampled by directing a portion thereof away from its projection axis and focusing the directed portion at a predetermined point. The boresight target material is located at the predetermined point and is heated by the focused radiation until it emits radiation in both the detectable infrared and visible bands. The emitted radiation is then redirected into both the infrared and visible detectors.

BRIEF DESCRIPTION OF THE DRAWINGS

FIG. 3 is a cross-sectional view of the embodiment of the present invention, as shown in FIG. 2.

DETAILED DESCRIPTION OF THE PREFERRED EMBODIMENT

Figure 1:
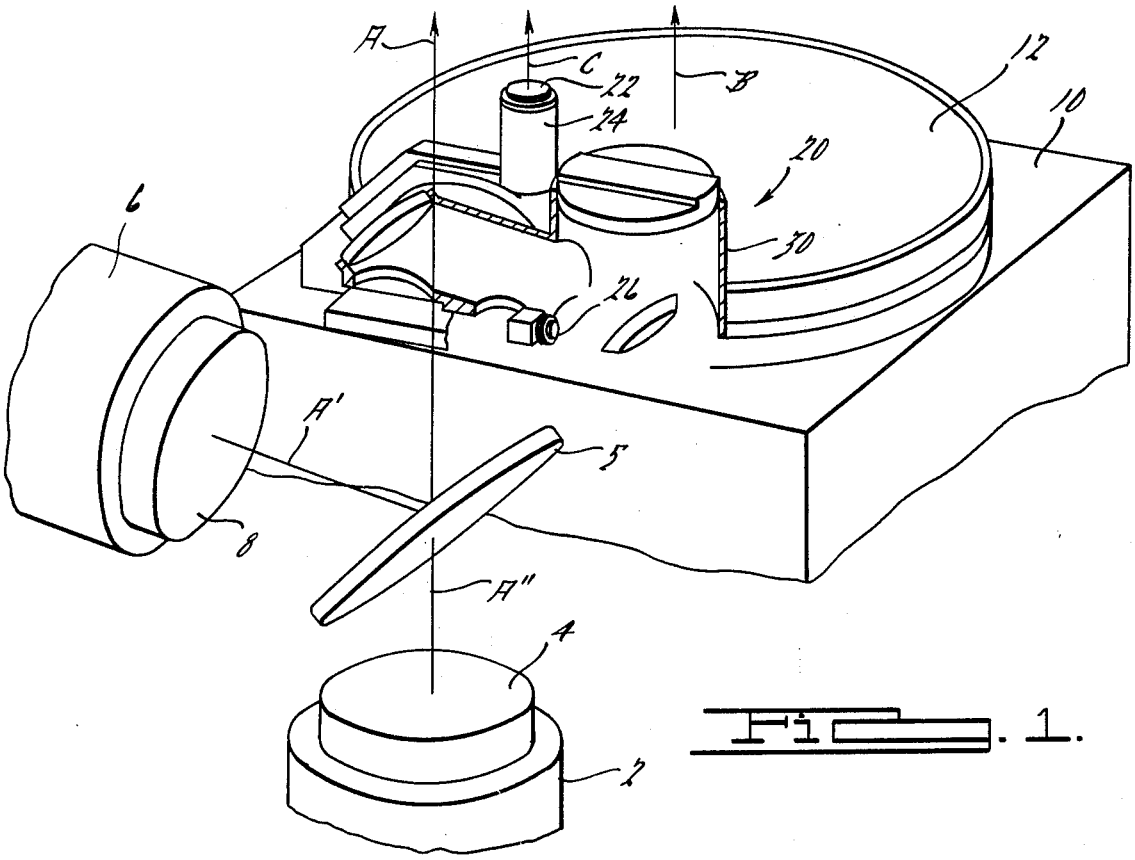
FIG. 1 shows an embodiment of the present invention in a disabled "stow" position.

In the preferred embodiment of the present invention, a visible wavelength band detector and an infrared band detector are mounted so as to receive images from their corresponding fields of view about parallel axes. This arrangement is shown in FIG. 1, wherein a visible band detector 6, such as a vidicon camera, receives an image through its objective lens 8. The optical axis of the visible detector 6 is indicated as A-A′ and is approximately central to the field of view of the objective 8.

An infrared band detector 10 is also shown in FIG. 1 which receives focused images from its objective 12 within a field of view about a central axis indicated as B.

A laser beam projector 2 is mounted to direct a collimated beam of monochromatic infrared radiation along a projection axis A″-A, wherein the A axis is common to both.

In FIG. 1, a boresight system 20 is shown in a disabled "stow" position wherein the optical elements thereof are rotated to a position so as to not interrupt the fields of view of the detectors or the laser beam.

The boresight system 20 is rotatable about a shaft 22 and an axis C to assume either the disabled "stow" position or the enabled "boresight" position.

Figure 2:
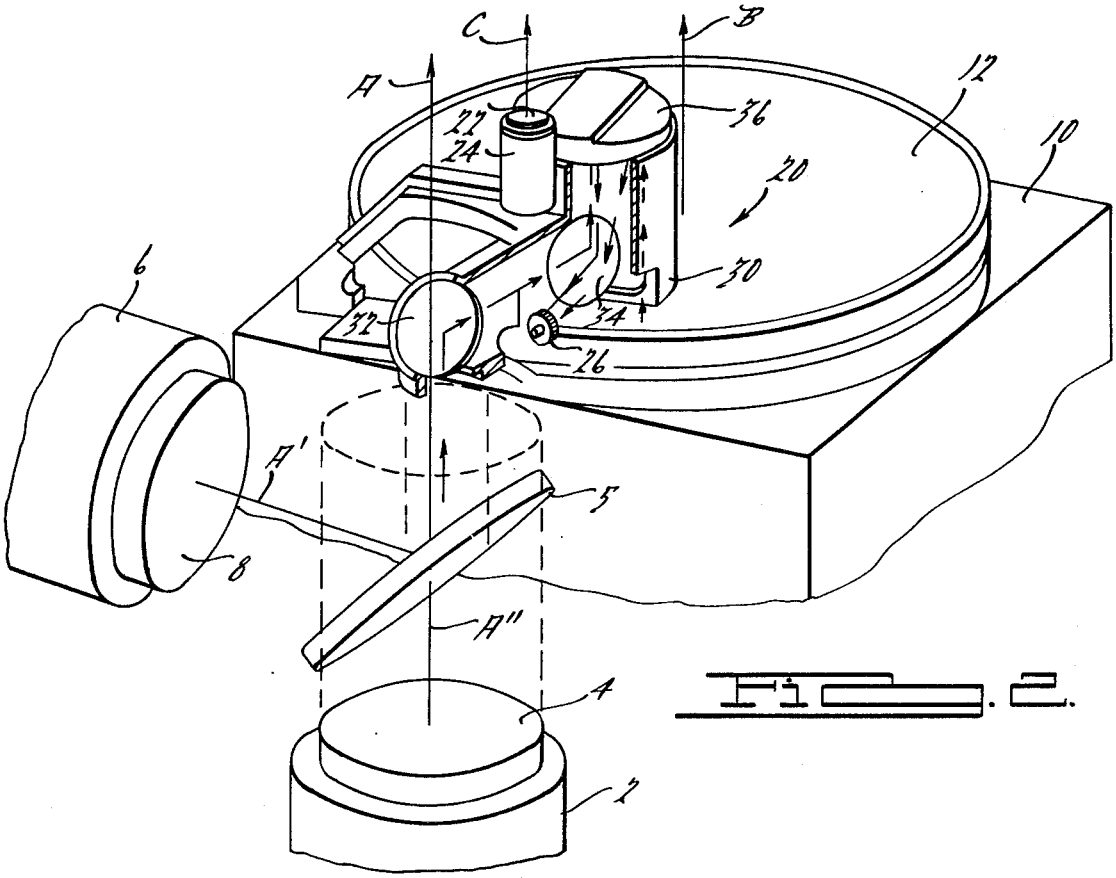
FIG. 2 shows an embodiment of the present invention in an enabled "boresight" position.
Figure 2:
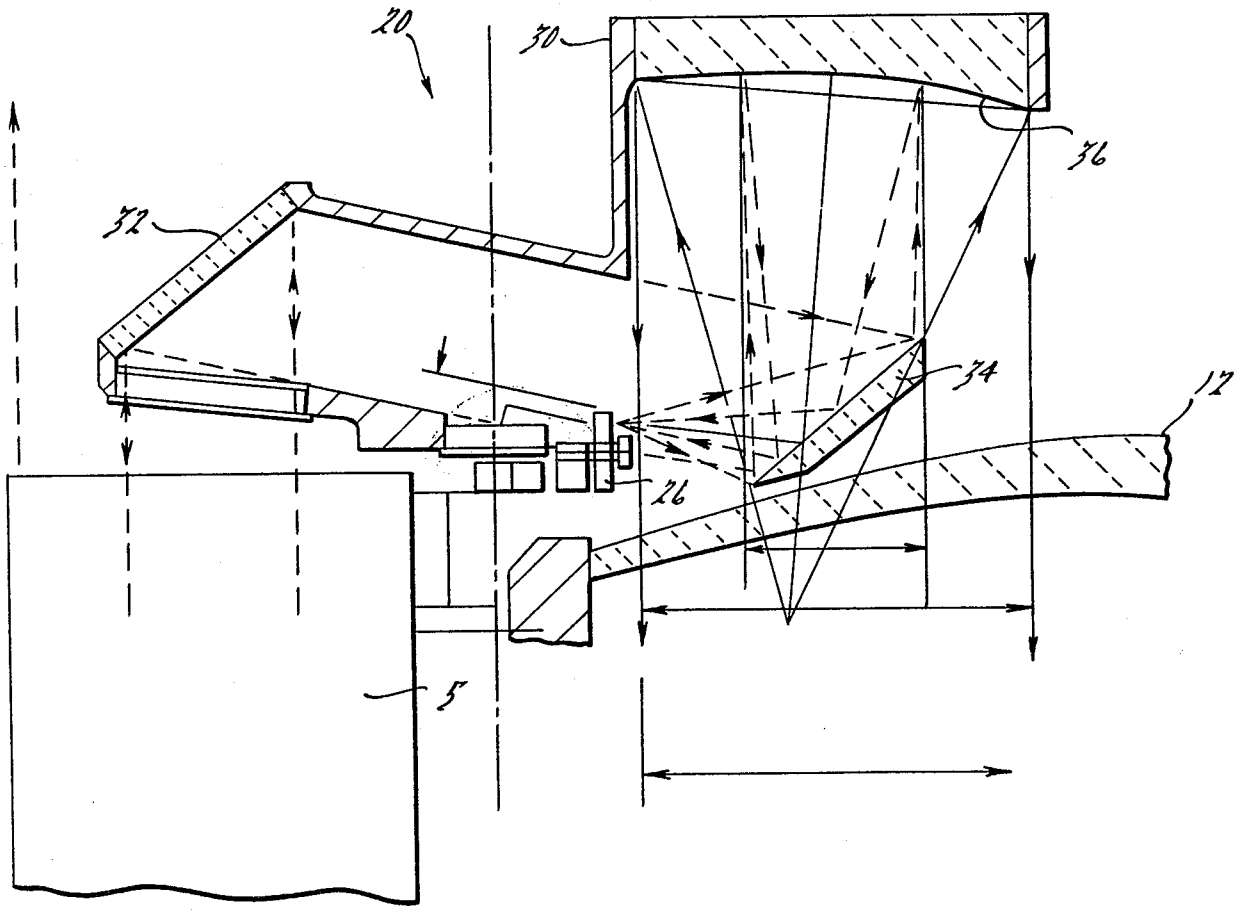

In FIG. 2, the boresight system 20 is shown rotated to its enabled position wherein a mirror 32 interrupts a portion of the projected laser beam being transmitted through a beam splitter 5.

Referring to FIGS. 2 and 3, it can be seen that the portion of the laser radiation interrupted by mirror 32 is reflected thereby to corresponding mirror 34, wherein the two mirrors 32 and 34 are mounted within a housing 30 to form a rhomboid pair. The collimated radiation reflected from the mirror 34 is focused by a parabolic mirror 36 to a predetermined focal point, which coincides with the location of a boresight target material 26. In this case, the location and angular orientation of the mirror 34 is used to locate the focal point of the mirror 36 off-axis and on the boresight target material 26.

The boresight target material 26 is uniquely selected and employed in this instance, due to its gray body thermal characteristics which allow for absorption of the focused infrared laser radiation and a responsive emission of a wide band of radiation including the detectable visible and infrared wavelength bands. Of course, insulative properties are also important for a boresight target material, since it is most desirable to prevent the spreading of the focused laser radiation beyond the predetermined point and also maintain a relatively small point of responsive emission therefrom. Materials such as sintered carbon granules, calcium silicate and asbestos have been found to be highly desirable for use as the boresight target material 26.

In each of the above materials it has also been found that infrared absorption results in responsive emissions in the ultraviolet, visible and infrared bands, and would be useful in effecting boresight alignment of an ultraviolet wavelength band detector, as well.

In operation, emission of radiation from the boresight target material 26 is reflected by the mirror 34 to the parabolic mirror 36 where it is collimated in a direction parallel to the A and B axes. A central portion of the emitted radiation is reflected by the mirror 34 to the mirror 32 and beam splitter 5 as a bright spot which is imaged by the vidicon 6. The remainder of the collimated radiation from the parabolic mirror 36 is transmitted through the infrared detector objective 12 and the appropriate infrared component thereof is detected by the infrared band detector 10.

Accordingly, the invisible radiation from the laser 2 is detectable in the field of view location by the visible band detector 6 as a bright spot in the center of the display and as a circular image by the infrared detector 10.

The foregoing preferred embodiment of the present invention employs a visible band detector which detects radiation in the wavelength range of approximately 0.5 to 0.7 μm; an infrared band detector which detects radiation in the wavelength range of approximately 8–12 μm; and a laser which radiates energy having a wavelength of approximately 1.06 μm. However, it should be noted that although the above described embodiment is viewed as the preferred embodiment, many optical path arrangements, many values of radiation projection and detection, and many element substitutions may be made while practicing the present invention as defined by the following claims.

We claim:

1. Apparatus including a laser for directing a beam of radiation at a first wavelength along a first axis towards a distant target; means for detecting radiation in a range of wavelengths from said distant target along said first axis; and means for checking the alignment of said detecting means with said laser radiation along said first axis, wherein said checking means includes a means for reflecting a portion of said laser radiation away from said first axis;

means for focusing said reflected portion of laser radiation to a predetermined point;

means located at said predetermined point for receiving said focused radiation and for responsively radiating energy at least in said range of wavelengths toward said focusing means, whereupon said focusing means collimates said radiated energy toward said relecting means and said reflecting means reflects said collimated radiated energy towards said detecting means.

2. An apparatus as in claim 1, wherein said responsively radiating means is formed of a material having thermal properties which approximate a gray body radiation emitter; and said first wavelength is outside said range of wavelengths.

3. An apparatus as in claim 1, wherein said first wavelength is in the infrared band and said range of wavelengths is in the visible band.

4. An apparatus as in claim 3, wherein said responsively radiating means is formed of sintered carbon granules.

5. An apparatus as in claim 3, wherein said responsively radiating means is formed of calcium silicate.

6. An apparatus as in claim 3, wherein said responsively radiating means is formed of asbestos.

7. Apparatus for boresighting a detector, mounted for sensing received infrared radiation within a predetermined wavelength band in a field of view along a first axis, with a beam of radiation outside said predetermined wavelength band generated by a commonly mounted laser along a second axis which is substantially parallel to said first axis, including:

means for deflecting a portion of said laser radiation in a direction away from said second axis;

means for focusing said deflected laser radiation at a predetermined point; and means located at said predetermined point for absorbing said focused radiation and for responsively emitting infrared radiation, having wavelengths that are at least within said predetermined wavelength band, from said point toward said focusing means;

said focusing means collimating said responsively emitted infrared radiation in a direction parallel to said first axis within said field of view toward said infrared detector.

8. Apparatus as in claim 7, wherein said laser generates infrared radiation having a wavelength outside said predetermined wavelength band.

9. Apparatus as in claim 7, wherein said absorbing and emitting means is made of a material having thermal properties which proximate a gray body radiation emitter.

10. An apparatus as in claim 7, wherein said absorbing and transmitting means is formed of sintered carbon granules.

11. An apparatus as in claim 7, wherein said absorbing and emitting means is formed of calcium silicate.

12. An apparatus as in claim 7, wherein said absorbing and emitting means is formed of asbestos.

13. Apparatus for boresighting a visible wavelength band detector having a field of view about a first axis and a commonly mounted infrared band detector having a field of view about a second axis substantially parallel to said first axis with a laser beam of a first wavelength directed along one of said first and second axes, including:

means for deflecting a portion of laser radiation in a direction away from said one of said first and second axes;

means for focusing said deflected portion of laser radiation to a predetermined point;

means located at said predetermined point for absorbing a portion of said focused laser radiation and for responsively emitting radiation from said point in at least said detectable visible and infrared bands;

said focusing means collimates and directs said emitted radiation towards said infrared band detector parallel to said second axis; and said deflecting means deflects a portion of said collimated emitted radiation towards said visible band detector, parallel to said first axis.

14. Apparatus as in claim 13, wherein said deflecting means comprises a pair of rhomboid mirrors oriented so that one of said pair of mirrors is in said beam and reflects that portion of the beam to the other of said pair of mirrors.

15. Apparatus as in claim 14, wherein said focusing means includes a parabolic mirror oriented to receive the portion of said beam reflected from the other of said pair of mirrors and to focus the received portion onto said absorbing and emitting means.

16. Apparatus as in claim 15, wherein said laser beam is outside said detectable visible and infrared bands.

17. An apparatus as in claim 15, wherein said absorbing and emitting means is formed of sintered carbon granules.

18. Apparatus as in claim 15, wherein said absorbing and emitting means is formed of calcium silicate.

19. Apparatus as in claim 15, wherein said absorbing and emitting means is formed of asbestos.

20. In a boresight apparatus including a first wavelength band detector having a field of view about a first axis, a laser for generating a second wavelength beam of radiation along a second axis substantially parallel to said first axis within said field of view, and a boresight optical system for sampling a portion of said second wavelength beam of radiation and supplying a beam of radiation of said first wavelength band to said detector within its field of view parallel to said first axis, an improvement comprising:

a boresight target material in said boresight optical system which absorbs a portion of said second wavelength beam of radiation and responsively emits radiation in at least said first wavelength band.

21. An improved boresight apparatus as in claim 20, wherein said boresight material is formed of sintered carbon granules.

22. An improved boresight apparatus as in claim 20, wherein said boresight material is formed of calcium silicate.

23. An improved boresight apparatus as in claim 20, wherein said boresight material is formed of asbestos.

24. A method of providing an alignment reference between the line of sight of a first detector sensitive to radiation of a first wavelength band and a collimated beam of radiation along a second line substantially parallel to said first detector line of sight, wherein said collimated beam of radiation is of a second wavelength outside said first wavelength band, including the steps of:

deflecting a portion of said collimated beam of radiation away from said second line;

focusing said deflected portion of said collimated beam of radiation at a predetermined point;

providing a boresight target material, having gray body thermal properties, at said predetermined point, wherein said material absorbs a portion of said focused radiation and responsively emits radiation from said predetermined point, in at least said first wavelength band; and collimating said emitted radiation in a direction toward said first detector parallel to said line of sight.

* * * * *